United States Patent [19]

Barbee

[11] 4,231,164

[45] Nov. 4, 1980

[54] APPARATUS AND METHOD FOR UNIFORMLY HEATING OR COOLING A MOVING WEB

[75] Inventor: Eugene H. Barbee, East Rochester, N.Y.

[73] Assignee: Eastman Kodak Company, Rochester, N.Y.

[21] Appl. No.: 938,612

[22] Filed: Aug. 31, 1978

[51] Int. Cl.[3] ..... F26B 3/04

[52] U.S. Cl. ..... 34/16; 34/23; 34/34; 34/155; 34/92; 118/68; 427/350; 427/372.2; 34/20

[58] Field of Search ..... 118/60, 68, 69; 427/350, 372 R, 372 A, 398 A, 398 C, 398 D, 444; 34/16, 20, 23, 34, 151, 155, 156, 160, 92, 233

[56] References Cited

U.S. PATENT DOCUMENTS

| | | | |
|---|---|---|---|
| 2,727,317 | 12/1955 | Offen | 34/155 |
| 3,065,098 | 11/1962 | Brooks | 117/34 |
| 3,284,920 | 11/1966 | Hayrinen et al. | 34/155 |
| 3,434,225 | 3/1969 | Knibiehly | 34/160 |
| 3,733,711 | 5/1973 | Haythornthwaite | 34/155 |
| 3,738,018 | 6/1973 | Herzhoff | 34/155 |
| 4,017,982 | 4/1977 | Goffredo | 34/66 |

*Primary Examiner*—Larry I. Schwartz
*Attorney, Agent, or Firm*—S. W. Gremban

[57] ABSTRACT

Apparatus including a chamber within which are mounted spaced rollers and an elongated housing interposed between a pair of rollers for heating or cooling a web transported over the rollers. A suction device in fluid communication with the chamber establishes a pressure differential on opposite sides of the web for assisting in producing a predetermined angle of contact of the web with the rollers, and for drawing fluid from the housing along the surface of the web for heating or cooling the web.

15 Claims, 6 Drawing Figures

APPARATUS AND METHOD FOR UNIFORMLY HEATING OR COOLING A MOVING WEB

BACKGROUND OF THE INVENTION

1. Field of the Invention

This invention relates to apparatus and method for changing the temperature of elongated moving webs, and in particular to an apparatus and method for uniformly heating or cooling a coated web.

2. Description of the Prior Art

U.S. Pat. No. 3,065,098 teaches cooling a moving web by conveying it on a supporting cushion of air flowing from perforations in a plurality of hollow stationary cylindrical tubes. Air is drawn downwardly into the space between adjacent tubes by a suction device which establishes a suction on the web, causing it to move in an undulated path. The cooling effect is produced solely by transfer of heat from the web to the air cushion, and thus is somewhat limited in effectiveness.

U.S. Pat. No. 3,738,018 describes guiding a moving web through a dryer by spaced pairs of guide rollers in engagement with one surface of the web. A suction device between each pair of rollers maintains a predetermined angle of contact of the web with the rollers. The drying effect results from contact of the web with the heated rollers and hot air in the dryer.

It is known in the cooling of webs coated with photographic emulsions to employ a suction device in cooperation with closely-spaced chill rollers. The suction device produces a downward air flow to assist in producing a predetermined angle of contact of the web with the chill rollers. The rollers may be idler rollers turned by the movement of the web thereon. A disadvantage of this known type of chilling device is that the web does not change temperature uniformly across its width resulting in a higher temperature at its width resulting in a higher temperature at its center portion and a lower temperature at its edge portions. This non-uniformity is believed to result from air flowing under the web from edge to center which has a greater cooling effect on the temperature of the edge portion of the web than on the temperature of the center portion. This non-uniform temperature gradient across the web results in variations in web or web coating properties, more particularly photographic coating properties, widthwise across the web.

In addition, where contact with the rollers is important for heat transfer, the length of web "chilled" during the period of time that the rollers achieve an equilibrium temperature following machine startup must be discarded due to non-uniform heat transfer. This constitutes extra cost to the manufacturer. This invention reduces the time required to reach temperature equilibrium and the footage of wasted web.

SUMMARY OF THE INVENTION

In accordance with the invention, a web such as a film is conveyed with one side of the web in contact with the periphery of at least two spaced parallel rollers having a temperature different from that of the web. A fluid pressure differential is established at opposite sides of the web to deflect the web section extending between adjacent rollers in a direction to produce a predetermined angle of contact of the web with the rollers. Since contact of the web with the rollers is important for heat transfer, increasing such contact, for example, by proper selection of the fluid pressure differential will increase the heat transfer and reduce the time required for the rollers to achieve temperature equilibrium. This, of course, reduces the footage of improperly treated web generated during this time period.

The fluid pressure differential also causes fluid such as air having a temperature different from that of the web to flow adjacent to the web and along its entire width. The advantage of this is to greatly reduce the non-uniform temperature gradient across the web which occurred heretofore. This results in reducing variations in web or web coating properties, particularly photographic coating properties, across the wedth of the web.

In a preferred embodiment, the invention is accomplished by a hollow elongated housing positioned between adjacent rollers with one surface adjacent to the web. The housing has one or more fluid discharge openings in the surface adjacent to the web and at least one fluid inlet opening. A fluid pressure condition is established on the same side of the web as the rollers to cause fluid to be drawn into the housing through the fluid inlet opening(s). The fluid pressure also causes fluid to be drawn from the housing through the fluid discharge openings. This establishes a flow of fluid in the space between the web and housing surface providing greater overall heat transfer and uniform widthwise web heating or cooling. In addition, the increased contact of the web with the rollers accelerates the achievement of an equilibrium temperature by the rollers. This decreases the cost of non-uniform discardable product produced during attainment of thermal equilibrium.

In another embodiment, fluid such as air is also drawn from the housing through an air discharge opening and directed against a roller, thereby further heating or cooling the rollers.

BRIEF DESCRIPTION OF THE DRAWINGS

In the more detailed description of the preferred embodiment of the invention set forth below, reference is made to the attached drawings which form a part of the application, and in which.

DETAILED DESCRIPTION OF THE INVENTION

Figure 1:
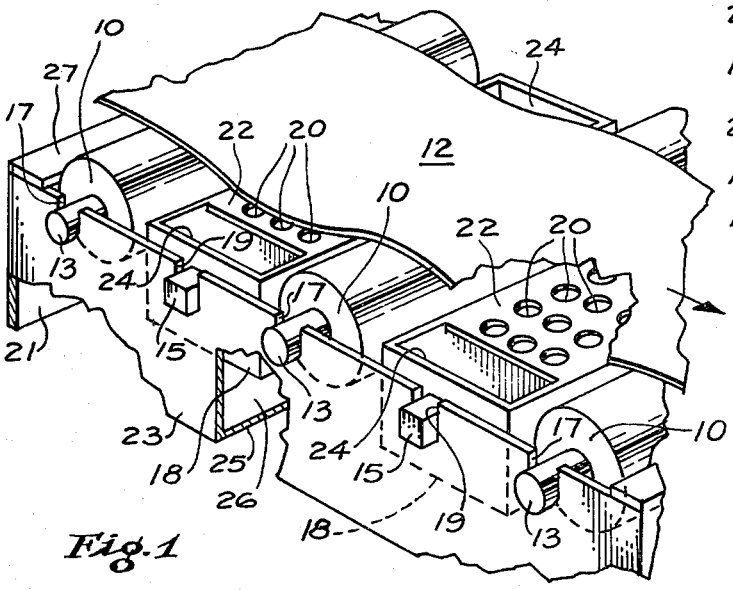
FIG. 1 is a perspective with a portion broken away of a preferred embodiment of the apparatus for heating or cooling a moving web.
Figure 2:
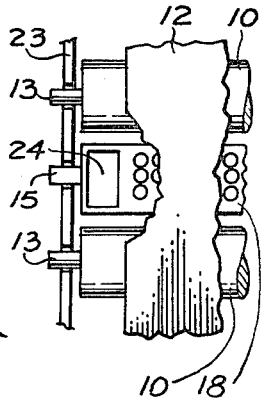
FIG. 2 is a segmental top plan view of a portion of the apparatus of FIG. 1.
Figure 3:
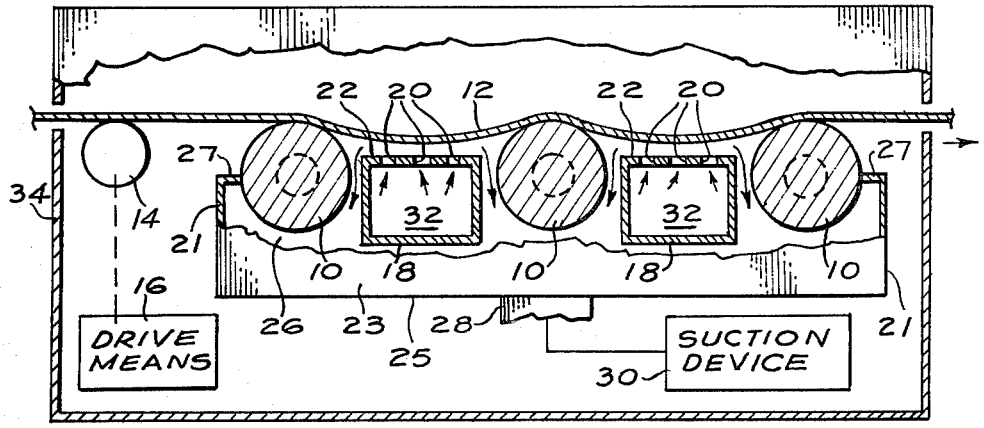
FIG. 3 is a schematic side sectional view of the apparatus of FIG. 1 with a portion broken away.

Referring to FIGS. 1–3, apparatus in accordance with this invention for uniformly heating or cooling a web 12 across its width comprises a plurality of spaced support members such as parallel rollers 10 disposed in a horizontal plane for supporting the web 12. The web 12 is conveyed lengthwise across rollers 10 by suitable means such as a drive roller 14 coupled to a drive means 16. Fluid (such as air) guiding means comprising an elongated housing 18 is positioned between adjacent rollers 10. Each housing 18 has a rectangular cross-section and a length approximately the same as that of the rollers. The housing 18 further has one or more air discharge openings 20 in an upper surface 22 adjacent to the web. For web chilling applications, the air discharge openings 20 are preferably arranged in a plurality of rows. These air discharge openings are countersunk (not shown) on the inside of the housing to prevent whistling upon passage of air through the openings. Alternatively, the air discharge openings 20 may comprise one or more elongated openings extending along the length of the housing. Also, the housing 18 may have a cross-section other than rectangular such as triangular, for example, provided the upper surface 22 faces the web along a predetermined length of the web. The surface 22 of housing 11 also has an air inlet opening 24 at each end of the housing located laterally outside of the edges of the web. The inlet opening 24 may be located at any other suitable exposed position of the housing in which it is not covered by the web such as the end of the housing.

The alternating rotatable rollers 10 and housings 18 are closely and generally equally spaced with a small cap or space between each housing and its adjacent roller at their closest point. The gap or space is illustrated in the drawing in exaggerated form in relation to the size of the rollers 10 and housings 18 for purposes of clarity. The housings 18 and rollers 10 are mounted in the open upper portion of a box-like enclosure or chamber 26 (FIGS. 1 and 2) rigidly mounted by any suitable means, not shown, within a room 34. Each housing is recessed a predetermined amount as measured from a horizontal plane extending through the housing surface 22 to a horizontal plane extending through the top of a roller 10 adjacent the housing. Although only three rollers are illustrated for exemplary purposes in FIGS. 2 and 3, it should be understood that any number may be employed in the practice of this invention.

The chamber 26 forms a part of means for establishing a pressure differential at opposite sides of web 12. The chamber 26 comprises two end walls 21, and two side walls 23, only a portion of which is shown in FIGS. 1–3, for supporting the ends of rollers 10 and housings 18. The support is acomplished by having stub shafts 13, 15 at the ends of the rollers 10 and housings 18 respectively nest within complementary notches 17, 19 respectively in the side walls 23. Chamber 26 further has a lower wall 25 and upper wall projections 27 defining the aforementioned open upper portion opposite wall 25. The open portion of chamber 26 is effectively closed off by rollers 10 and housings 18 spanning side walls 23, and by web 12 as it is conveyed in contact with the rollers. The web width is less than the distance between inlet openings 24 so that the openings are uncovered and in fluid communication with room 34.

The chamber 26 is connected by a conduit 28 to a suction device 30, such as an exhaust fan, to reduce the fluid or air pressure in chamber 26 below the air pressure maintained within room 34. Since the pressure within room 34 is preferably atmospheric pressure, the reduced air pressure within chamber 26 is preferably subatmospheric. Naturally, if the room pressure is above atmospheric, the pressure within chamber 26 need not be subatmospheric. The reduced preferably subatmospheric air pressure produced in chamber 26 has several functions. Firstly, it causes the web sections extending between adjacent rollers 10 to be deflected by the higher preferably atmospheric pressure above the web to produce a predetermined angle of contact of the web with the rollers. The exact angle of contact is influenced, for example, by parameters such as the fluid pressure differential above and below the web and by the tension of the web supplied by the drive means 14, 16. By proper selection of the parameters, the amount of deflection of the web sections is controlled so that the web sections do not rub or engage the upper surface 22 of housing 18. Secondly, the pressure differential between the air pressure in room 34 and the reduced air pressure established in chamber 26 also causes air at room pressure to enter into a cavity 32 within housing 18 through air inlet openings 24 and to be drawn through air discharge openings 20 to produce a heating or cooling air flow (depending upon the temperatures of the web and air). The heating or cooling air flow from air discharge openings 20 passes through the space between the lower surface of web 12 and the upper surface 22 of housing 18. By virtue of the air flow moving along and in engagement with the lower surface of web 12, the overall web heating or cooling effect is increased. Furthermore, the heating or cooling air flow reaches the center portion of the web, as well as the edges of the web, thus improving the widthwise temperature uniformity of the web.

Although the portion of the gaps between rollers 10 and housing 18 and projections 27, and between the roller ends and side walls 23 are uncovered between the web edges and side walls 23 (FIG. 2) resulting in some air leakage through them into chamber 26, the area of such uncovered gap portions is negligible in relation to the entire system and does not unduly affect the operation of the apparatus.

The room 34 within which the apparatus of this invention is preferably enclosed is maintained at a predetermined temperature by any suitable means. The preferably solid metallic rollers 10 attain the predetermined room temperature within a short period of time, and act as heat or cold sinks for heating or cooling the web. The amount of heating or cooling of the web by the rollers 10 is dependent, for example, upon the temperature of the rollers, the nature of the web, and the angle of web wrap or contact with the rollers.

The various variables or parameters such as the area and configuration of the air discharge openings 20, the distance or gap between each roller 10 and its adjacent housings 18, the pressure differential between pressures acting on opposite sides of the web, web tension, nature of the web, type of web coating, if any, etc., are selected and balanced to provide the desired web heating or cooling air flow for each web heating or cooling application.

Figure 4:
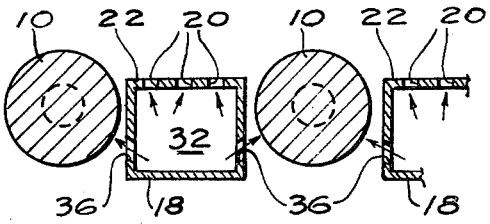
FIG. 4 is a segmental schematic side sectional view of another embodiment of the apparatus of this invention with a portion broken away.

FIG. 4 shows another embodiment of the invention. In this embodiment, housing 18 has fluid discharge openings 36, such as slots, in the side surfaces of housing 18 adjacent to rollers 10. These openings 36 are in addition to the plurality of fluid discharge openings 20 facing web 12. Fluid is withdrawn not only through openings 20, but also through openings 36 by the reduced or subatmospheric pressure within chamber 26 and directed against adjacent rollers 10 for assisting in heating or cooling the rollers.

Figure 5:
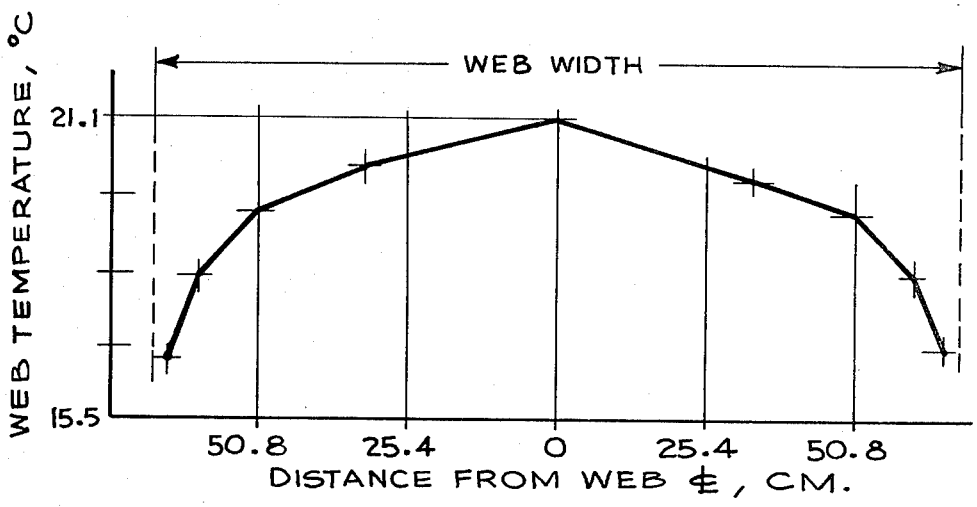
FIG. 5 is a graph showing the variation of web temperature widthwise across the web with no air flow from the elongated housing of the apparatus.
Figure 6:
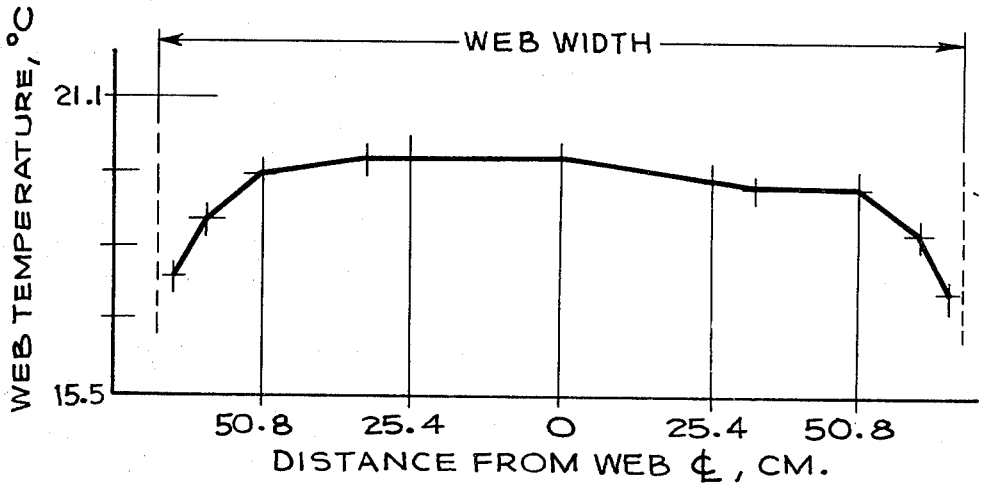
FIG. 6 is a graph showing the variation of web temperature widthwise across the web under the influence of a cooling air flow from the elongated housing of the apparatus.

FIGS. 5 and 6 are plots of web temperature in degrees Celsius over the width of the web in centimeters from each side of the web centerline for a web chilling application utilizing apparatus of the type illustrated in FIGS. 1–3. The web temperatures for both tests were monitored by the same temperature sensing means under the same operating conditions such as type and temperature of the emulsion coating, web tension, room temperature, pressures, etc. For the FIG. 5 test, the air discharge openings 20 were closed off so that no web cooling air flow was produced. For the FIG. 6 test, the air discharge openings 20 were open and a web cooling air flow was produced. FIG. 5 illustrates the considerable temperature gradient which exists between the highest value at the web centerline and lowest value at the web edges when no web cooling air flow is employed in conjunction with the chill rollers. Such a temperature gradient produces non-uniformities that are particularly troublesome when the web is coated with a photographic emulsion or the like. FIG. 6 illustrtes a substantial "smoothing out" of this widthwise temperature gradient due to the use of the cooling air flow provided by the elongated housings 18 between chill rollers 12 as described above. In the case of webs coated with photographic emulsion, this more uniform cooling decreases non-uniform drying and sensitometric effects across the width of the web.

The invention has been described in detail with particular reference to preferred embodiments, but it will be understood that variations and modifications can be effected within the spirit and scope of the invention as described.

What is claimed is:

1. A method for changing the temperature of a web, the method comprising the steps of:

(a) conveying the web with one side of the web in contact with at least two spaced parallel rollers;

(b) establishing a fluid pressure differential at opposite sides of the web which tends to deflect a web section extending between the rollers in a direction to produce a predetermined angle of contact of the web with the rollers; and (c) producing a flow of fluid having a temperature different from that of the web in a direction substantially longitudinally of the web along and in engagement with the entire width of the one side of the web section.

2. A method for changing the temperature of a moving web, the method comprising the steps of:

(a) conveying the web with one side of the web in contact with at least two spaced parallel rollers;

(b) maintaining the rollers at a temperature different than that of the moving web to transfer heat between the web and the rollers;

(c) establishing a fluid pressure on the one side of the web which is less than the fluid pressure on the other side of the web, whereby the pressure on the other side tends to deflect a web section extending between the rollers in a direction to produce a predetermined angle of contact of the web with the rollers; and (d) producing a flow of fluid having a temperature different from that of the web in a direction substantially longitudinally of the web adjacent to and in engagement with the entire width of the one side of the web section.

3. A method as claimed in claim 2 wherein the pressure on the other side of the web is at least equal to atmospheric pressure, and the pressure on the one side of the web is less than atmospheric pressure.

4. A method for cooling a moving web coated with a photographic emulsion, the method comprising the steps of:

(a) conveying the web with one side of the web in contact with a plurality of spaced chill rollers, and in close proximity to an elongated housing extending across the web; and (b) establishing a fluid pressure condition on the one side of the web which is less than the fluid pressure on the other side of the web and within the housing to deflect a web section extending between the rollers in a direction to produce a predetermined angle of contact of the web with the rollers, and to produce a flow of cooling fluid from air discharge openings in the housing parallel to and in engagement with the one side of the web section.

5. A method for cooling a moving web coated with a photographic emulsion, the method comprising the steps of:

(a) conveying the web with one side of the web in contact with a plurality of spaced chill rollers and in close proximity to an elongated housing located between each pair of chill rollers and extending across the web; and (b) establishing an air pressure condition on the one side of the web which is less than the air pressure on the other side of the web and within the housing to deflect a web section extending between the rollers in a direction to produce a predetermined angle of contact of the web with the rollers, and to produce a flow of cooling air from one set of air discharge openings in the housing parallel to and in engagement with the one side of the web section to cool the web, and a flow of cooling air from another set of air discharge openings in the housing against the rollers to cool the rollers.

6. Apparatus for changing the temperature of a moving web, the apparatus comprising:

(a) at least two spaced support members for supporting one side of the moving web;

(b) means for establishing a pressure differential between opposite sides of the web to (1) deflect a web section extending between the support members in a direction toward said support members, and (2) produce fluid flow of a temperature different than the temperature of the web; and (c) means coupled to the aforementioned means for guiding the fluid flow in a direction substantially longitudinally of the web along and in engagement with the entire width of the one side of the web section to transfer heat between the web and the fluid.

7. Apparatus for changing the temperature of a moving web, the apparatus comprising:

(a) a plurality of spaced rollers for supporting one side of the moving web;

(b) means for conveying the web in contact with the rollers;

(c) means for establishing a pressure differential between opposite sides of the web to (1) deflect a web section extending between adjacent rollers in a direction to produce a predetermined angle of contact of the web with the rollers and (2) produce a fluid flow having a temperature different than that of the web; and (d) means coupled to the aforementioned means for guiding the fluid flow in a direction substantially longitudinally of the web parallel to and in engagement with the entire width of the one side of the web section.

8. Apparatus for changing the temperature of a moving web, the apparatus comprising:

(a) at least two spaced parallel rollers for supporting one side of the moving web, the rollers having a temperature different than that of the moving web to transfer heat between the web and the rollers;

(b) means for establishing a pressure differential between pressure acting at opposite sides of the web to (1) deflect a web section extending between the rollers in a direction to produce a predetermined angle of contact of the web with the rollers, and (2) produce fluid flow of a temperature different than the temperature of the web; and (c) means coupled to the aforementioned means for guiding the fluid flow in a direction substantially longitudinally of the web along and in engagement with the entire width of the one side of the web section to transfer heat between the web and the fluid.

9. Apparatus for changing the temperature of a moving web, the apparatus comprising:

(a) a plurality of spaced rollers for supporting one side of the moving web;

(b) means for conveying the web in contact with the rollers;

(c) means for establishing a temperature of the rollers different than that of the web to thereby change the temperature of the web as it contacts the rollers;

(d) means for establishing a pressure differential at opposite sides of the web to (1) deflect a web section extending between adjacent rollers in a direction to produce a predetermined angle of contact of the web with the rollers, and (2) produce fluid flow of a temperature different than the temperature of the web; and (e) means coupled to the aforementioned means for guiding the fluid in a direction substantially longitudinally of the web parallel to and in engagement with the entire width of the one side of the web section.

10. Apparatus for cooling a moving web, the apparatus comprising:

(a) at least two spaced parallel chill rollers for supporting one side of the moving web;

(b) means for conveying the web in contact with the rollers;

(c) an elongated housing positioned between the rollers on the one side of the web, the housing having a surface spaced from a web section extending between adjacent rollers and having at least one fluid discharge opening in the surface; and (d) means for establishing a fluid pressure condition on the one side of the web for deflecting the web section in a direction to produce a predetermined angle of contact of the web with the rollers, and to cause fluid to be drawn from the housing through the discharge opening to thereby establish a cooling fluid flow through the space between the web section and the housing surface.

11. Apparatus for cooling a moving web, the apparatus comprising:

(a) a plurality of spaced parallel rollers for supporting one side of the moving web in contact therewith;

(b) means for conveying the web over the rollers;

(c) means for cooling the rollers to thereby cool the web as it contacts the rollers;

(d) an elongated housing positioned between each pair of the rollers, the housing having (1) an air cavity, (2) an air inlet to the air cavity, (3) a surface on the one side of the web spaced from a web section extending between adjacent rollers, and (4) at least one air discharge opening; and (e) means for establishing an air pressure on the one side of the web which is less than the air pressure on the other side of the web whereby the pressure on the other side of the web tends to deflect the web section in a direction to produce a predetermined angle of contact of the web with the rollers, and whereby the difference in pressure on the one and other sides of the web causes air to be drawn into the housing through the air inlet and expelled from the housing through the cavity and the discharge opening to thereby establish a cooling air flow through the space between the web section and the housing surface.

12. Apparatus as claimed in claim 11 wherein the pressure on the other side is equal to atmospheric pressure, and the pressure on the one side is less than atmospheric pressure.

13. Apparatus for cooling a moving web, the apparatus comprising:

(a) a plurality of spaced chill rollers for supporting and contacting one side of a moving web;

(b) a plurality of elongated housings, each having a rectangular cross-section and being interposed between two adjacent rollers on one side of the web, each housing further having a cavity, a surface spaced from a web section extending between adjacent rollers, a plurality of air discharge openings in the surface, and an air inlet opening for air at atmospheric pressure at one end thereof; and (c) means for establishing a subatmospheric pressure condition on the one side of the web which causes air at atmospheric pressure to be drawn into the housing cavity through the air inlet opening and out of the housing cavity through the air discharge openings to thereby establish a cooling air flow through the space between the web section and the housing surface.

14. Apparatus for cooling a moving web coated with a photographic emulsion, the apparatus comprising:

(a) a plurality of spaced parallel solid metallic rollers for supporting and contacting one side of the moving web;

(b) means for conveying the web over the rollers;

(c) means for cooling the rollers to thereby cool the web as it contacts the rollers;

(d) an elongated housing interposed between two adjacent rollers on the one side of the web, the housing having (1) an interior cavity for air, (2) a surface spaced from a web section extending between adjacent rollers, (3) a plurality of air discharge openings in the surface, and (4) an air inlet opening for air at atmospheric pressure at one end thereof;

(e) a box-like enclosure mounted below the rollers and having an open end with the rollers, housing and web positioned over the open end and effectively closing off the open end; and (f) suction means connected to the enclosure for establishing a subatmospheric pressure condition in the enclosure adjacent the one side of the web to cause the web section to be deflected by atmospheric pressure in a direction to produce a predetermined angle of contact of the web with the rollers, and to cause air at atmospheric pressure to be drawn into the housing cavity through the air inlet opening and to be discharged from the housing cavity through the plurality of air discharge openings to thereby produce a cooling air flow through the space between the web section and the surface of the housing.

15. Apparatus for cooling a moving web coated with a photographic emulsion, the apparatus comprising:

(a) a plurality of spaced parallel solid metallic rollers for supporting and contacting one side of the moving web;

(b) means for conveying the web over the rollers;

(c) means for cooling the rollers to thereby cool the web as it contacts the rollers;

(d) an elongated housing interposed between two adjacent rollers on the one side of the web, the housing having (1) an interior cavity for air, (2) a surface spaced from a web section extending between adjacent rollers, (3) a plurality of first air discharge openings in the surface, (4) an air inlet opening for air at atmospheric pressure at one end thereof, (5) a second air discharge opening in said housing spaced from said first air discharge openings;

(e) a box-like enclosure mounted below the rollers and housing and having an open end with the rollers, housing and web positioned over the open end and effectively closing off the open end; and (f) suction means connected to the enclosure for establishing a subatmospheric pressure condition in the enclosure adjacent the one side of the web to cause the web section to be deflected by atmospheric pressure in a direction to produce a predetermined angle of contact of the web with the rollers, and to cause air at atmospheric pressure to be drawn into the housing cavity through the air inlet opening and to be discharged from the housing cavity through the plurality of first air discharge openings to thereby produce a cooling air flow through the space between the web section and the first surface of the housing, and to be directed from the housing cavity through the second discharge opening against the roller adjacent thereto to cool the roller.

* * * * *